US005260643A

United States Patent [19]

Sandhu

[11] Patent Number: 5,260,643

[45] Date of Patent: Nov. 9, 1993

[54] PROGRAMMABLE REFERENCE VOLTAGE GENERATOR

[75] Inventor: Bal S. Sandhu, Fremont, Calif.

[73] Assignee: National Semiconductor Corporation, Santa Clara, Calif.

[21] Appl. No.: 915,426

[22] Filed: Jul. 16, 1992

[51] Int. Cl.[5] ..... G05F 3/24

[52] U.S. Cl. ..... 323/225; 323/229; 323/281; 323/317; 323/350; 365/226

[58] Field of Search ..... 323/225, 229, 220, 281, 323/317, 907, 350, 352; 365/226-228

[56] References Cited

U.S. PATENT DOCUMENTS

| | | | |
|---|---|---|---|
| 4,015,192 | 3/1977 | Koyanagi | 325/464 |
| 4,435,679 | 3/1984 | Bedard et al. | 323/350 |
| 4,644,250 | 2/1987 | Hartgring | 323/225 |
| 4,754,167 | 6/1988 | Conkle | 307/296 R |
| 4,961,045 | 10/1990 | Gray et al. | 323/281 |
| 5,084,666 | 1/1992 | Bolash | 323/281 |

FOREIGN PATENT DOCUMENTS

| | | | |
|---|---|---|---|
| 60-220412 | 11/1985 | Japan | 323/281 |
| 3-288217 | 12/1991 | Japan . | |

OTHER PUBLICATIONS

"Programmable Power Supply," IBM Tech. Discl. Bul., vol. 33, No. 11, pp. 460, 461, Apr. 1991.

*Primary Examiner*—William H. Beha, Jr.
*Attorney, Agent, or Firm*—Flehr, Hohbach, Test, Albritton & Herbert

[57] ABSTRACT

A programmable reference voltage generator includes a diode arrangement for generating a reference voltage in response to a control current. An array of memory cells is provided for adjusting the control current, the memory cell array including a plurality of memory cells connected to the diode arrangement through a plurality of current paths. Each of the memory cells is disposed to conduct current when programmed to store a first binary value, and to not conduct current when programmed to store a second binary value. A programming circuit is used to store a selected one of the first and second binary values in each memory cell, thereby causing the reference voltage to assume a selected magnitude.

12 Claims, 5 Drawing Sheets

PROGRAMMABLE REFERENCE VOLTAGE GENERATOR

The present invention relates generally to biasing networks included within electronic circuits, and particularly to voltage references used in such networks.

BACKGROUND OF THE INVENTION

In the design of various analog and digital circuits, such as D/A converters, buffer arrangements, and voltage regulators, it is necessary to establish a stable bias reference within the circuit. The bias reference will ideally be substantially independent of variation in both temperature and power supply. Either currents or voltages may serve as references, but voltages are often preferred in order to facilitate interface with the remainder of the circuit.

Reference voltage circuits can be classified by the source of the voltage standard from which, for example, a bias current may be derived. Convenient standards include the base-emitter voltage of a bipolar transistor, the thermal voltage, $V_T$, and the breakdown voltage of a Zener diode. Each of these can be utilized in order to establish power-supply independence, but the first two alternatives are relatively sensitive to temperature variation. Although the reference voltage produced by Zener diodes is generally less dependent on temperature, variation on the order of +200 to +500 ppm/°C. can be expected. Accordingly, some form of compensation must be employed in order to meet typical integrated circuit (IC) temperature stability requirements of ≦50 ppm/°C.

Conventional temperature compensation schemes utilized in monolithic IC design generally rely on some type of component matching techniques to reduce reference variation. In particular, a predictable source of temperature drift is paired with another source of opposite polarity which can be scaled by a temperature-independent scale factor. Then, through appropriate circuit design, the effects of the two opposite-polarity drifts are made to cancel. Such an approach, however, requires an initial prediction as to the manner in which each source drifts with temperature. Moreover, the reliability of such a forecast diminishes when the temperature coefficients of the matched components are relatively large or nonlinear. It follows that a compensation network capable of being adjusted subsequent to physical realization would be of significant utility.

As is well known, variation in IC fabrication processes also tend to cause the magnitude of voltage references to deviate from a desired value. Such process variation can reduce manufacturing yields when an anticipated value of a voltage or current is altered as a consequence of reference voltage variation. As a specific example, processing-induced reduction in the "trip current" of sense amplifiers used in conjunction with memory circuits often renders them unusable given the precision with which this current must be controlled. A considerable yield reduction results since the trip current may not be increased subsequent to device fabrication.

Accordingly, a need in the art exists for a voltage generator for producing a reference voltage capable of being adjusted subsequent to device fabrication.

SUMMARY OF THE INVENTION

In summary, the present invention is a programmable reference voltage generator for providing a reference voltage capable of being set to one of a plurality of predefined magnitudes. The voltage generator includes a diode arrangement for generating a reference voltage in response to a control current. An array of memory cells is provided for adjusting the control current, the memory cell array including a plurality of memory cells connected to the diode arrangement through a plurality of current paths. Each of the memory cells is disposed to conduct current when programmed to store a first binary value, and to not conduct current when programmed to store a second binary value. A programming circuit is used to store a selected one of the first and second binary values in each memory cell, thereby causing the reference voltage to assume a selected magnitude.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
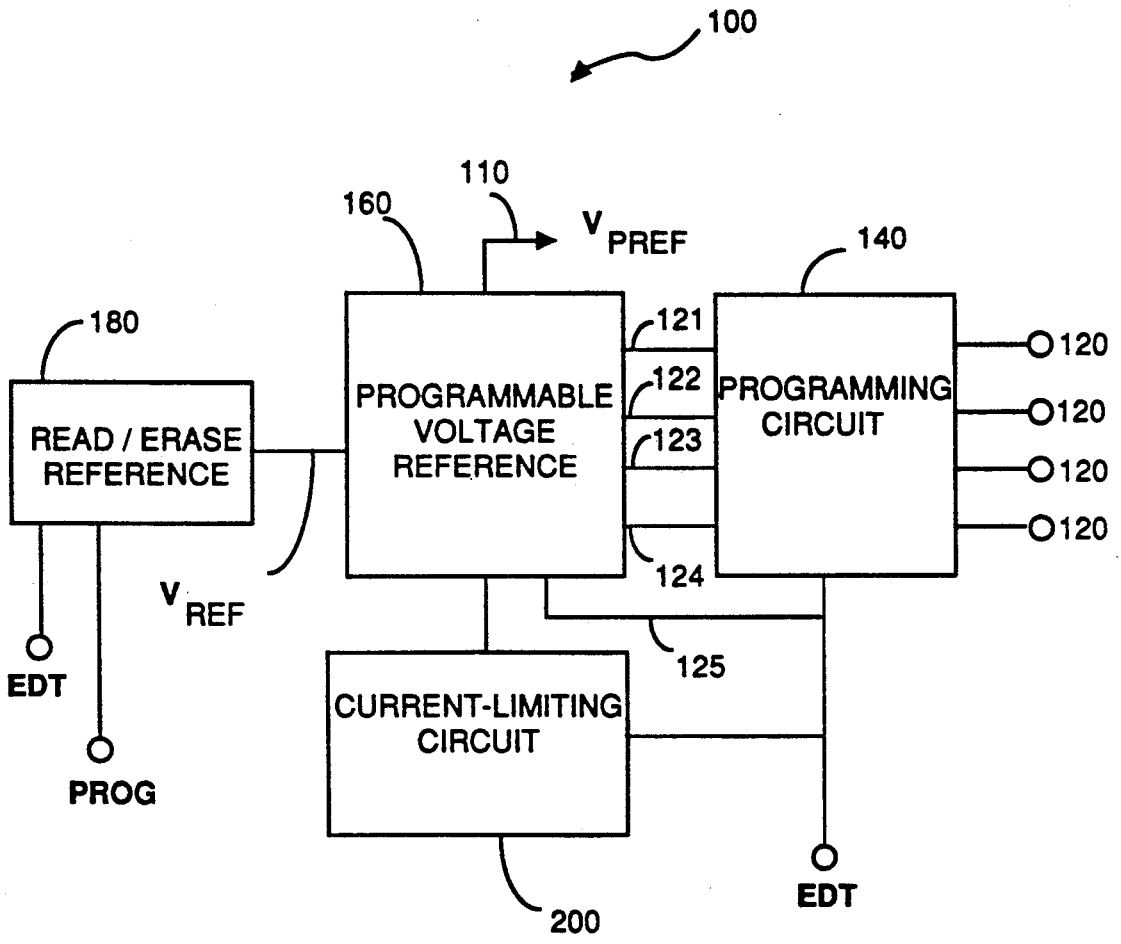
FIG. 1 shows a preferred embodiment of the programmable reference voltage generator circuit of the present invention.

Referring to FIG. 1, there is shown a preferred embodiment of the programmable reference voltage generator circuit 100 of the present invention. As is described below, voltage generator circuit 100 is disposed to provide a programmed reference voltage $V_{PREF}$ on output line 110, where $V_{PREF}$ has a magnitude determined by a digital control word impressed on input terminals 120. Input terminals 120 address a programming circuit 140 which serves to program via control terminals 121–125, in accordance with the digital control word applied to input terminals 120, an array of memory cells (not shown in FIG. 1) within a programmable voltage reference network 160. A read/erase voltage reference 180 provides a reference voltage $V_{REF}$ to programmable reference network 160. The magnitude of $V_{REF}$ is predicated on whether reference module 160 is operative in an "edit" mode or in a "read" mode. The edit mode is selected by raising edit select line EDT to a power supply voltage Vcc, while read mode is selected by holding the EDT line at O V. $V_{REF}$ is set to zero volts during a programming cycle of the edit mode, to between 12 and 15 Volts during an erase cycle of the edit mode, and to approximately 2.2 Volts during read mode.

In the edit mode $V_{PREF}$ is isolated from the memory cell array within reference module 160 while the array is being programmed or erased by programming circuit 140. In read mode (i.e., non-programming) operation, the magnitude of $V_{PREF}$ is adjusted to correspond to the control word information stored within the memory cell array. The programmable generator circuit 100 further includes a current-limiting compensation circuit 200 disposed to control the manner in which the magnitude of $V_{PREF}$ varies as a function of the information stored within the memory cell array.

Figure 2:
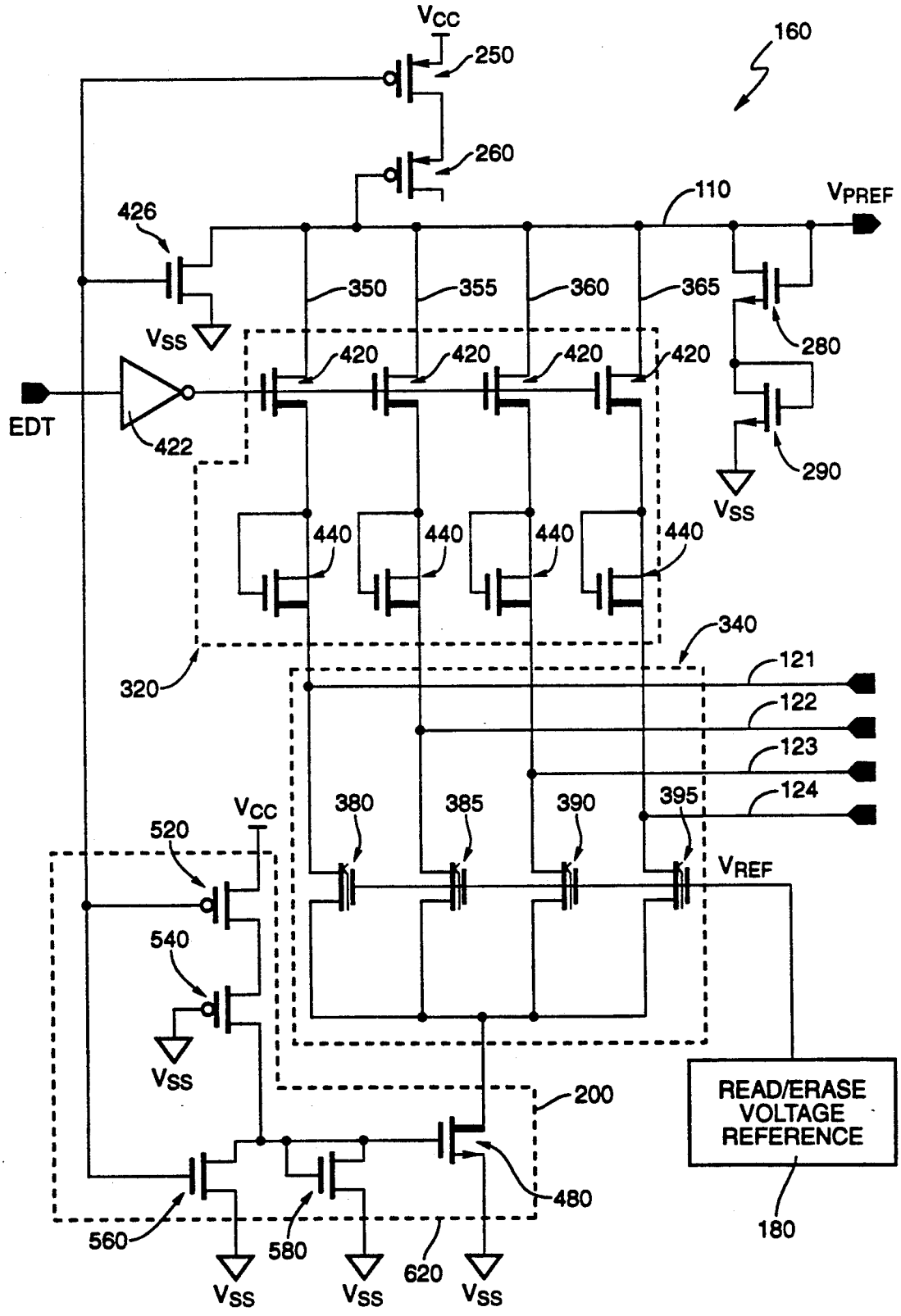
FIG. 2 is a schematic representation of a programmable voltage reference network and an accompanying compensation circuit.

FIG. 2 is a schematic representation of the programmable voltage reference network 160 and compensation circuit 200. The voltage reference network 160 includes a first p-channel MOS transistor 250 serially connected between power supply voltage Vcc and a diode-connected p-channel MOS transistor 260. P-channel transistors 250 and 260, together with first and second diode-connected n-channel transistors 280 and 290, cooperate to set the maximum value of the magnitude of $V_{PREF}$ to approximately VTP+2VTN, where VTP and VTN respectively correspond to the p-channel and n-channel MOS threshold voltages. In particular, diode-connected p-channel MOS transistor 260 forms a voltage divider with diode-connected n-channel transistors 280 and 290. Accordingly, for a positive supply voltage Vcc of approximately five volts the n-channel transistors 280 and 290 will be dimensioned relative to p-channel transistor 260 such that $V_{PREF}$ is nominally equal to slightly less than Vcc/2.

The programmable voltage reference 160 further includes a transistor isolation network 320 connected between output line 110 and a memory cell array 340. The isolation network 320 defines first, second, third and fourth current paths 350, 355, 360 and 365 extending between output line 110 and first, second, third and fourth memory cells 380, 385, 390 and 395 included within the memory cell array 340. As shown in FIG. 2, each of the current paths 350, 355, 360 and 365 includes a high-voltage, thick-gate n-channel MOS transistor 420. The transistors 420 may be implemented by MOS devices having source regions with ion implants which increase the source-to-gate breakdown voltage. The gate of each high-voltage transistor 420 is connected to an inverter 422 driven by the EDT line, with each transistor 420 being rendered conductive by the gate voltage of approximately five volts applied thereto during read mode (EDT=OV). The transistor isolation network 320 further provides a diode-connected, thick-gate, n-channel MOS transistor 440 connected in series between each MOS transistor 420 and the memory cell array 340. The thick-gate transistors 420 and 440 are capable of supporting a gate to source voltage of approximately 15 volts.

During read-mode operation the high-voltage transistors 420 within the transistor isolation network 320 are turned on by applying a mode-select voltage of approximately zero volts to the EDT line. It follows that during the read mode the current paths 350, 355, 360 and 365 respectively short circuit the output line 110 to the memory cells 380, 385, 390 and 395. In the programming mode EDT line is raised to Vcc (typically 5 volts), which results in Vss being applied to the gate terminals of the transistors 420 through the inverter 422. The transistors 420 and 250 are thus turned off in the programming mode, thereby allowing transistor 426 to pull $V_{PREF}$ to ground (Vss) during programming cycle operation. Hence, during programming mode the transistor isolation network creates an open circuit between output line 110 and the memory cell array 340. In addition, the gate of the current-limiting transistor 480 is pulled to ground (Vss) by transistor 560, thereby isolating the memory cells 380, 385, 390 and 395 from ground.

The memory cells 380, 385, 390 and 395 will preferably be realized by electrically erasable programmable read-only memory (EEPROM) cells having gate terminals commonly held at the voltage $V_{PREF}$. During operation in the edit mode the magnitude of $V_{REF}$ is driven to approximately zero volts when selected ones of the memory cells 380, 385, 390 and 395 (hereinafter referred to as the EEPROM cells) are programmed to a first (i.e., conductive) binary state. During erase cycles in the edit mode the magnitude of $V_{REF}$ is maintained at a voltage VPP (typically between 12 and 15 volts) so as to allow the EEPROM cells to be erased. Erasure of the EEPROM cells places each in a second (i.e., non-conductive) binary state.

An EEPROM cell may be programmed to be conductive in the read mode by raising the control line 121–125 connected thereto to VPP while $V_{REF}$ is held at zero volts. As is well known, this programming operation causes a net positive charge to accumulate upon a floating gate of each EEPROM programmed to be conductive. The residual positive charge lowers the threshold turn-on voltage of the EEPROM to below zero volts, and generally to approximately −1.0 volts. An EEPROM is selected to be non-conductive during read mode simply by holding the corresponding control line 121–125 and $V_{REF}$ at approximately zero volts during the programming interval.

In erasing of EEPROM cells during edit mode operation the positive charge accumulated by the floating gates of those EEPROM cells programmed to be conductive during a previous edit mode is removed, thereby causing the turn-on voltage of each EEPROM cell within the array 340 to become approximately Vcc. This charge removal is effected during the erase cycle by raising $V_{REF}$ to VPP and applying zero volts to each of the control lines 121–125.

As is discussed below, in both the program and erase cycles of the edit mode a current-limiting transistor 480 connected to each of the EEPROM cells is turned off, thus preventing any appreciable current flow through the EEPROM cells during the edit mode. During read mode operation transistor 480 is turned on so as to allow current to flow through those EEPROM cells programmed to be conductive. Accordingly, during read mode operation the magnitude of the current from the p-channel transistors 250 and 260 shunted away from the diode-connected transistors 280 and 290 by cell array 340 will be proportional to the number of EEPROM cells within the cell array 340 programmed to be conductive. Since a reduction in the current through the diode-connected transistors 280 and 290 commensurately lowers $V_{PREF}$, it follows that the magnitude of $V_{PREF}$ can be modified by programming a selected number of EEPROM cells to be conductive.

Figure 3:
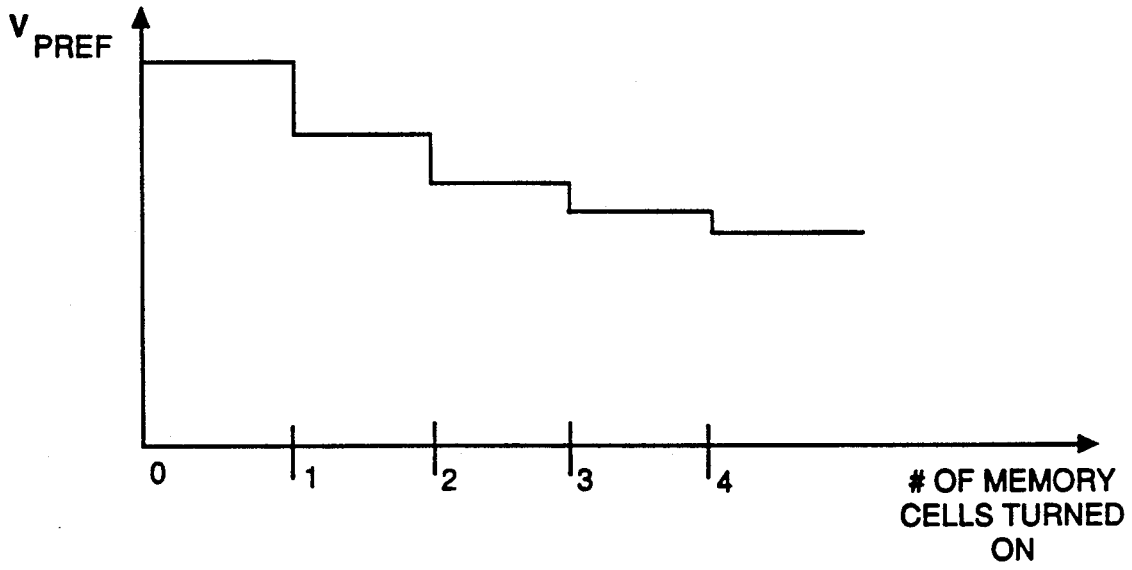
FIG. 3 illustratively represents the manner in which a programmed reference voltage VPREF varies as a function of the number of cells within a memory cell array programmed to be conductive.

For example, FIG. 3 illustratively represents the manner in which the voltage $V_{PREF}$ varies as a function of the number of EEPROM cells programmed to be conductive. The profile of FIG. 3 is obtained by biasing current-limiting transistor 480 such that transistor 480 becomes saturated when approximately two EEPROM cells are programmed to be conductive. As is indicated by FIG. 3, $V_{PREF}$ is capable of assuming five distinct magnitudes when four EEPROM memory cells are included within the memory cell array 340.

Referring to FIG. 2, current-limiting transistor 480 is biased to the level described above by first and second p-channel MOS compensation transistors 520 and 540, in conjunction with a first n-channel MOS compensation transistor 560 and a second n-channel diode-connected compensation transistor 580. The gates of the first p-channel compensation transistor 520 and of the first n-channel compensation transistor 560 are connected to the EDT line, while the gate of the second p-channel compensation transistor is connected to the voltage Vss. Specifically, the compensation transistors 520, 540, 560 and 580 are dimensioned so that a current-limiting control voltage impressed on line 620 is of a magnitude (typically 2.2 to 2.3 volts) sufficient to place transistor 480 in saturation when two EEPROM cells within the array 340 are turned on.

Since during read-mode operation the EDT line is held at approximately zero volts, first p-channel compensation transistor 520 is turned on and first n-channel compensation transistor 560 is turned off. It follows that the current-limiting control voltage on line 620 is set by the ratio of current drive between the p-channel compensation transistors 520 and 540 on the one hand and the diode-connected n-channel transistor 580 on the other. As noted above, during read mode operation the current-limiting transistor 480 is turned on by the current-limiting control voltage on line 620.

Again, during edit mode the current-limiting transistor 480 is turned off while the EEPROM cells within the array 340 are being programmed or erased. Transistor 480 is made to be non-conductive during edit mode as a consequence of transistor 560 being turned on, which pulls line 620 to ground (Vss). The clamping action of diode-connected n-channel transistor 580 maintains transistor 480 in a non-conductive state during the edit mode by preventing the control voltage on line 620 from rising above approximately one volt. Transistor 560 is also conductive during the edit mode, and hence further serves to prevent turn-on of transistor 480 by pulling line 620 towards Vss.

The compensation network 200 also serves to make the programmed reference voltage $V_{PREF}$ substantially invariant to differences between the n-channel and p-channel devices within the generator circuit 100 resulting from variation in IC fabrication processes. For example, when processing variation results in the p-channel devices having a higher than desired current-drive capability relative to the current drive capability of the n-channel devices, the resulting mismatch between the p-channel compensation transistors 520 and 540 and the n-channel compensation transistor 580 forces the current-limiting control voltage on line 620 to rise. Consequently, the current-limiting transistor 480 draws an increased current from the memory cell array 340. However, the increased current conducted by transistor 480 does not induce a contemporaneous shunting of current from the diode-connected n-channel transistors 280 and 290 (FIG. 2) since this same processing variation augments the current provided by the p-channel transistors 250 and 260. It follows that the current through the n-channel transistors 280, and hence the magnitude of $V_{PREF}$, are relatively unaffected by processing variations. In a reciprocal manner, the compensation circuit 200 prevents fabrication irregularities resulting in a higher than desired n-channel to p-channel current-drive ratio from altering the magnitude of $V_{PREF}$.

Figure 4:
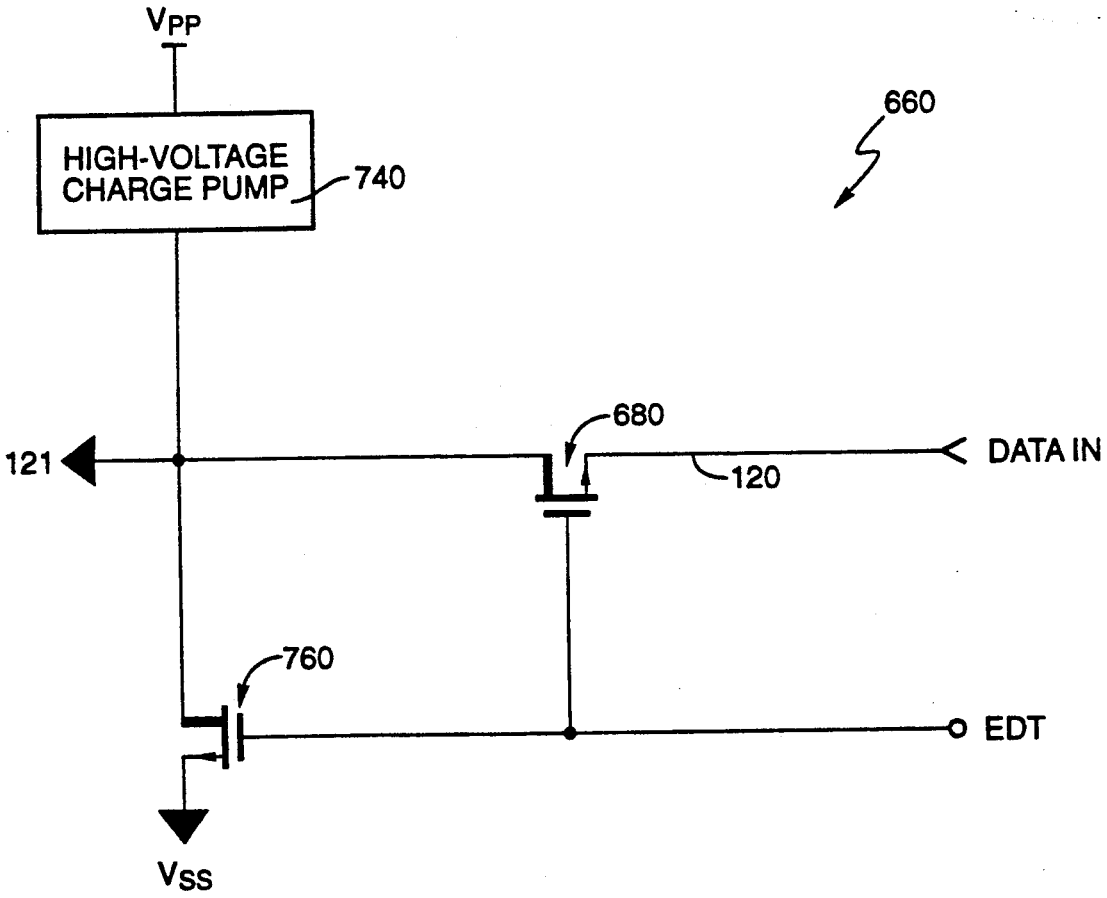
FIG. 4 is a schematic representation of a first programming network included within a memory cell programming circuit.

FIG. 4 is a schematic representation of a first programming network 660 included within the programming circuit 140 (FIG. 1). The programming network 660 operates to impress a control bit on the first control line 121 in response to one of the input data bits applied to input lines 120. The programming circuit 140 further includes second, third and fourth programming networks (not shown) substantially identical to the first programming network 660, for generating the control bits impressed on the second, third and fourth control lines 122, 123 and 124. The programming network 660 includes an n-channel thick-gate MOS transistor 680 serially connected between input line 120 and the first control line 121. The gate of thick-gate transistor 680 is connected to the EDT line, which also drives the gate of a p-channel thick-gate MOS transistor 760. Raising the EDT line to Vcc during edit mode programming turns on the n-channel transistor 680 when a logical low (e.g., zero volts) is present on input data line 120, while transistor 680 remains turned off during the programming cycle if a logical high (e.g., Vcc) is present on input line 120. In this way impression of a voltage Vcc upon input line 120 allows the charge supplied by a high-voltage charge pump 740 to capacitively accumulate on transistors 680 and 760, thereby raising the first control line to the bias voltage VPP supplied to charge pump 740. When a logical low is applied to input line 120 during programming mode, transistor 680 is conductive and thus pulls line 121 to ground (Vss). In this way a logical low is impressed upon the control line 121.

During the erase cycle of the edit mode a logical low is applied to input line 120, which causes transistor 680 to become turned on and thereby pull line 121 to ground (Vss).

Figure 5:
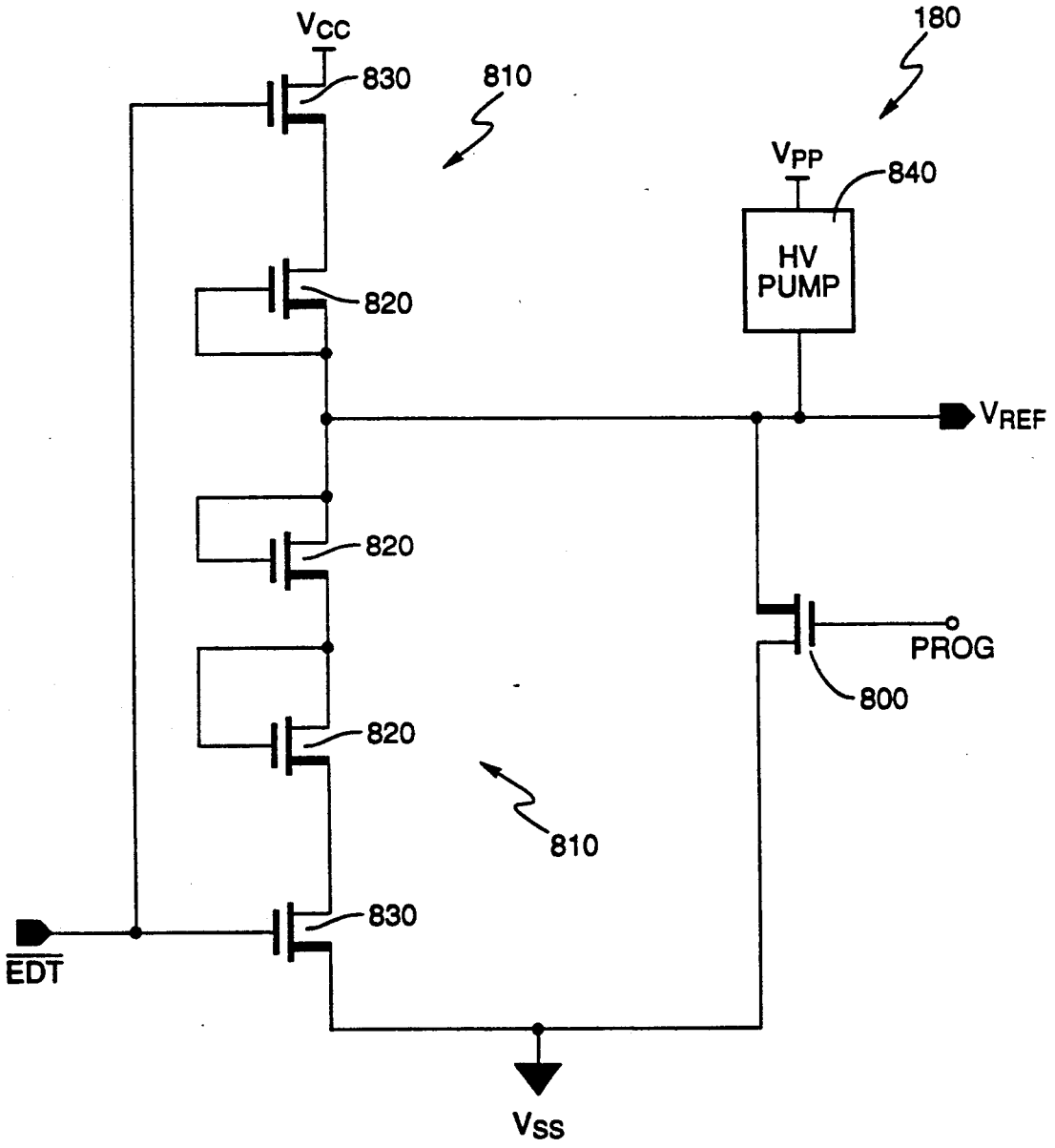
FIG. 5 shows a schematic representation of a read/erase voltage reference network.

FIG. 5 shows a schematic representation of the read/erase voltage reference 180. As was noted above, the voltage reference 180 raises $V_{REF}$ to VPP (12 to 15 Volts) during the erase mode and to approximately 2.2. Volts during read mode. In addition, $V_{REF}$ is set to zero volts during programming intervals. During operation in the erase mode a program (PROG) line is held at Vss, which results in a high-voltage n-channel transistor 800 being turned off. Since the EDT line is at approximately VCC during erase mode, a voltage divider 810 comprised of several diode-connected n-channel 820 transistors and a pair of high-voltage n-channel transistors 830 is also turned off (i.e., is non-conductive). It follows that a high-voltage charge pump 840 pulls $V_{REF}$ to VPP during the erase mode. During programming mode the PROG line is raised to Vcc in order to turn on transistor 800, thereby allowing $V_{REF}$ to be pulled to Vss. In read mode operation both the EDT and PROG lines are held at Vss. Consequently, during read mode transistor 800 is turned off and voltage divider 810 is conductive. The transistors 820 and 830 within the divider 810 are dimensioned such that during read mode operation the voltage $V_{REF}$ is approximately 2.2 Volts.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims. For example, it may be advantageous in certain applications to vary the number and type of programmable cells included within the memory cell array from that disclosed herein.

What is claimed is:

1. A programmable reference voltage generator comprising:

a voltage divider having a plurality of circuit components connected in series between upper and lower power supply nodes, said voltage divider generating a reference voltage at a node connecting two of said plurality of circuit components; and current adjustment means, coupled to said voltage divider, for conducting current in parallel with a portion of said voltage divider wherein magnitude of said conducted current is determined by information stored within a plurality of memory cells.

2. The programmable reference voltage generator of claim 1 further including a current-limiting transistor connected to each of said memory cells, said current-limiting transistor having control terminal upon which is impressed a current-limiting control voltage, and compensation circuit means for synthesizing said current-limiting control voltage, said compensation circuit means including a first transistor of a first polarity.

3. The programmable reference voltage generator of claim 2 wherein one of said circuit components within said voltage divider comprises a second transistor of said first polarity for supplying current to said voltage divider;

whereby variation in transistor fabrication processing affects current-sourcing characteristics of said first and second transistors in like manner, thereby rendering magnitude of said current-limiting control voltage substantially immune from said processing variation.

4. A programmable reference voltage generator comprising:

diode means for generating a reference voltage in response to a control current; memory cell means for adjusting said control current, said memory cell means including a plurality of memory cells connected to said diode means through a plurality of current paths wherein each of said memory cells is disposed to conduct current when programmed to store a first binary value and to not conduct current when programmed to store a second binary value; and means for programming each of said memory cells to a selected one of said first and second binary states, thereby causing said reference voltage to assume a selected magnitude.

5. The programmable reference voltage generator of claim 4 wherein said memory cell means includes current-limiting transistor means for limiting current conducted by said memory cells.

6. The programmable reference voltage generator of claim 5 wherein said current-limiting transistor means includes:

a current-limiting transistor connected to each of said memory cells, said current-limiting transistor having a control terminal upon which is impressed a current-limiting control voltage, and compensation circuit means for synthesizing said current-limiting control voltage, said compensation circuit means including a first transistor of a first polarity.

7. The programmable reference voltage generator of claim 6 further including current source means for supplying current to said diode means and to said memory cell means, said current source means including a second transistor of said first polarity;

whereby variation in transistor fabrication processing affects current-sourcing characteristics of said first and second transistors in like manner, thereby rendering magnitude of said current-limiting control voltage substantially immune from said processing variation.

8. The voltage generator of claim 7 wherein each of said memory cells comprises an EEPROM memory cell.

9. The voltage generator of claim 4 wherein said programming means further includes a transistor isolation network for open-circuiting said current paths during programming of said memory cells.

10. The voltage generator of claim 6 wherein said current-limiting control voltage is selected such that said current-limiting transistor becomes operative in a saturation mode when at least one of said memory cells is programmed in said first binary state.

11. In a voltage generator circuit having a diode arrangement operatively connected to a plurality of memory cells by a plurality of current paths, a method for generating a programmed reference voltage across said diode arrangement comprising the steps of:

providing a control current to said diode arrangement;

adjusting said control current by connecting a plurality of memory cells to said diode arrangement wherein each of said memory cells is disposed to conduct current when programmed to store a first binary value and to not conduct current when programmed to store a second binary value; and programming each of said memory cells to a selected one of said first and second binary states, thereby causing said reference voltage to assume a selected magnitude.

12. The method of claim 11 further including the step of limiting said current conducted by said memory cells programmed to store said first binary value such that said reference voltage is altered in a predetermined manner as a function of said programming of said memory cells.

* * * * *